United States Patent [19]

Runquist

[11] Patent Number: 4,510,917

[45] Date of Patent: Apr. 16, 1985

[54] PASSIVE MODE SOLID FUEL BURNING FURNACE

[76] Inventor: Paul Runquist, 1030 Neil Creek Rd., Ashland, Oreg. 97502

[21] Appl. No.: 572,160

[22] Filed: Jan. 18, 1984

Related U.S. Application Data

[63] Continuation-in-part of Ser. No. 335,701, Dec. 30, 1981, abandoned.

[51] Int. Cl.[3] ..... F24B 5/02

[52] U.S. Cl. ..... 126/76; 126/60; 126/68; 126/77; 126/73; 126/163 R; 126/290

[58] Field of Search ..... 126/10, 60, 68, 70, 126/73, 76, 77, 103, 163 R, 290

[56] References Cited

U.S. PATENT DOCUMENTS

| | | | |
|---|---|---|---|
| 2,433,036 | 12/1947 | Fellows | 126/76 X |
| 2,481,165 | 9/1949 | Landry | 126/76 |
| 2,564,713 | 8/1951 | Miles | 126/76 X |
| 4,186,719 | 2/1980 | Dalsin | 126/143 |
| 4,326,495 | 4/1982 | Millar | 126/77 |
| 4,426,992 | 1/1984 | Martenson | 126/77 |
| 4,432,335 | 2/1984 | Kilham | 126/60 |
| 4,466,358 | 8/1984 | Christian | 110/211 |

FOREIGN PATENT DOCUMENTS

| | | | |
|---|---|---|---|
| 877997 | 1/1943 | France | 126/73 |
| 67097 | 11/1943 | Norway | 126/163 R |
| 3264 | of 1887 | United Kingdom | 126/76 |

*Primary Examiner*—Samuel Scott
*Assistant Examiner*—Allen J. Flanigan
*Attorney, Agent, or Firm*—Chernoff, Vilhauer, McClung, Birdwell & Stenzel

[57] ABSTRACT

A downdraft furnace comprises a combustion component associated with a heat exchange component. The combustion component includes a fuel chamber, a primary combustion chamber and a secondary combustion chamber operatively interconnected by a constricting throat opening. Log support structure is provided to carry split logs and at an angle of approximately thirty degrees from the horizontal. The support structure and the logs define a primary air flow passage directed toward the throat opening through which primary air flow is directed at the bottom portions of the fuel segments. The inlet includes closure means to restrict and vertically vary slightly the path of primary air flow. Passage means are provided to introduce secondary air directly at the throat opening. The inlet includes closure means to restrict and vertically slightly vary the path of primary air flow.

16 Claims, 10 Drawing Figures

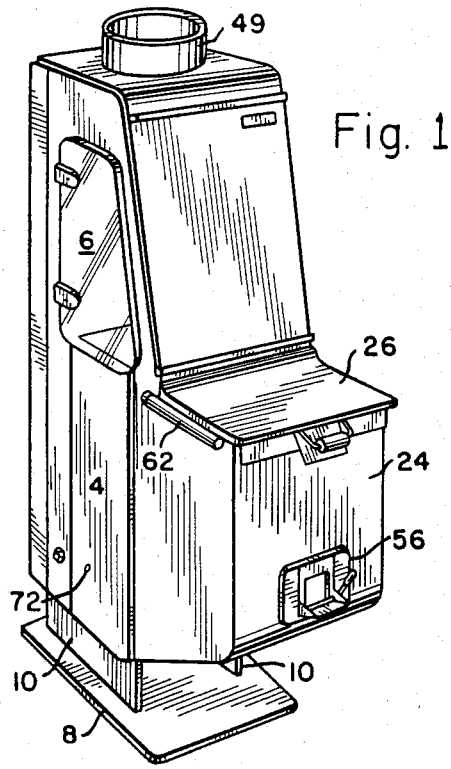
Fig. 1.
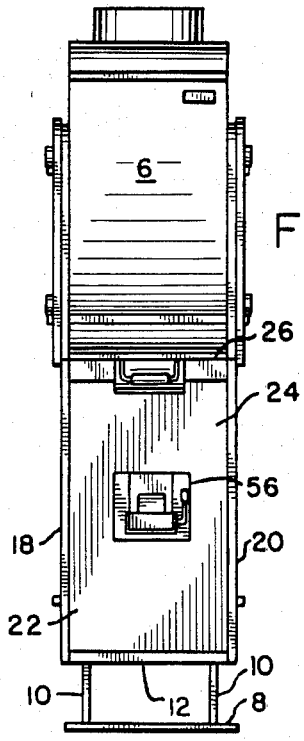
Fig. 3.
Fig. 4.
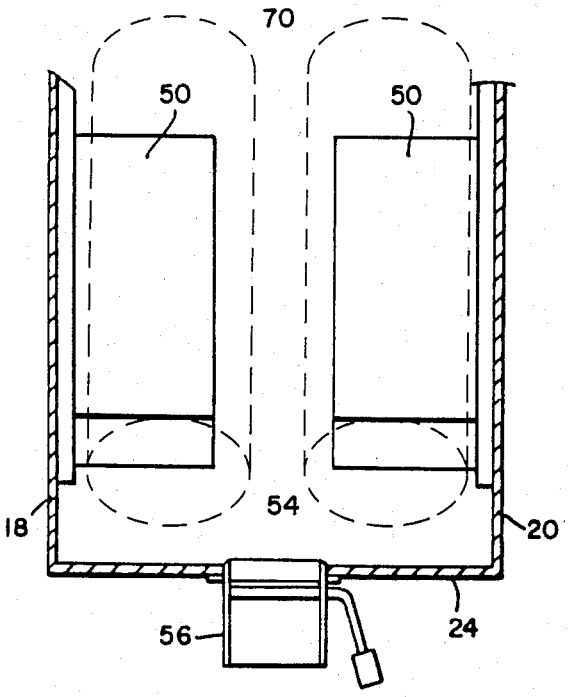
Fig. 5.
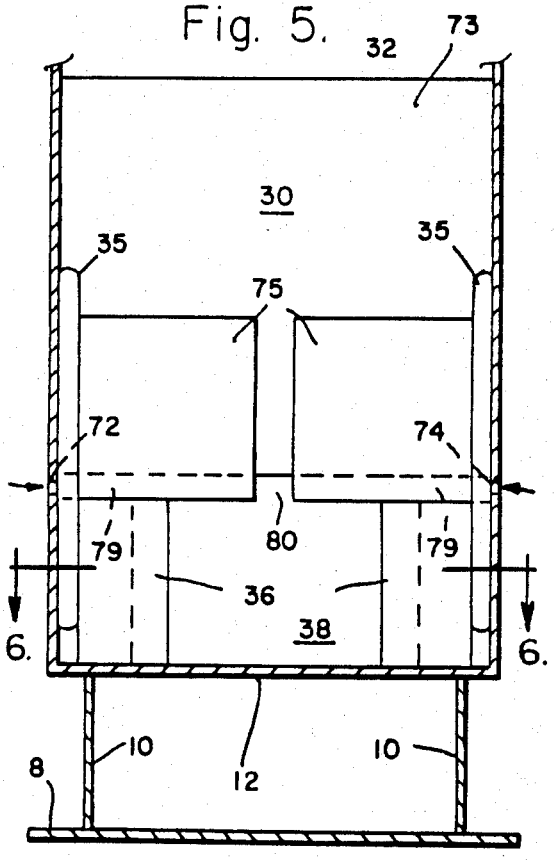

PASSIVE MODE SOLID FUEL BURNING FURNACE

CROSS-REFERENCE TO RELATED APPLICATIONS

This application is a continuation-in-part of application Ser. No. 335,701 filed Dec. 30, 1981, now abandoned.

BACKGROUND OF THE INVENTION

1. Field of the Invention

This invention relates to a solid fuel burning furnace, and in particular to such a furnace of the downdraft type which directs a controlled jet of primary air over the bottom surface of the fuel while operating in a passive mode, that is, without the addition of mechanical air circulation to improve combustion efficiency.

In the optimum condition, the release of stored energy in the combustion of solid fuel should be accomplished in a controlled manner with consequent reduction or virtual elimination of pollutant discharge to the atmosphere. The complexity of combustion is demonstratable through subtle variation of reaction conditions and thus combustion responds to even dimensional variations of an optimized combustion environment.

Solid cellulose fuels decompose or burn in the presence of sufficient heat to produce a charcoal or solid fuel component and a volatile or gaseous fuel component. It is this volatile fuel which requires satisfaction of several specific criteria to accomplish complete combustion. A combustible mixture which is a proper balance of volatile fuel and oxygen must be delivered to the combustion environment in which provisions are made to ensure the presence of high ignition temperature and sufficient turbulence to ensure a fuel and oxygen contact. The temperature of the combustion environment must be sufficient for the particular fuel being burned, and, in the case of wood, eleven hundred degrees (1100°) Fahrenheit is considered minimum.

Some state of the art devices utilize mechanically assisted components such as fans to induce high velocity air into the combustion chamber to generate high temperature and turbulence. Although these devices may achieve improved combustion efficiency and minimized emissions to the atmosphere, certain disadvantages are inherent in these active systems.

The high temperatures and rates of heat production of mechanically aspirated systems often require the practical disadvantages of expensive combustion chambers, control mechanisms, active components and heat storage elements. These cost disadvantages have thereby minimized their in service use and appeal.

Updraft furnaces whose primary combustion products exit at or near the top of the combustion chamber are common due to their simple design and low initial cost. They tend however to have the in service disadvantages of low thermal efficiencies and high pollutant discharge to the atmosphere.

Downdraft furnaces whose outlets are at or near the bottom of the combustion chamber offer the advantages of higher thermal efficiencies and lower emissions to the atmosphere if appropriate considerations for fuel loading, temperature generation and oxygenation are made.

The disclosed invention has been demonstrated to accomplish an unusually high level of clean combustion while burning various cellulose materials generally with no visible atmospheric emissions and accomplished through non-obvious aerodynamic and structural features.

2. Description of the Prior Art

A relevant downdraft stove of the type here under consideration is disclosed in U.S. Pat. No. 2,564,713 dated Aug. 21, 1951. This patent discloses a stove designed specifically for coal burning with provisions for coal feeding zones, secondary combustion and a radiation chamber. This invention and the very similar U.S. Pat. No. 2,433,036 fail however to anticipate and address the characteristics of longitudinal fuels such as logs or sticks which by their nature alter the flow of air along and around them. The administration of logs to either of these prior art devices would thereby alter their function significantly from that of operation with only coal. The loose filling characteristics of coal and the structural characteristics of logs should therefore be recognized in order to optimize the downdraft function.

In U.S. Pat. No. 2,564,713 a diffused air flow is generally applied to the base of the fuel loading with a trajectory perpendicular to the surface on which fuel would lie. This has several disadvantages in the presence of log type fuels. First, logs loaded upon the inclined surfaces therein described would be stimulated to burn upwards through the log layers and thereby involving more fuel than just logs upon the bottom layer. Secondly this trajectory in combination with the inclined support surfaces when logs are placed lengthwise on the incline will tend to guide the flame by convection upwards and to the front away from rather than to the secondary combustion chamber as disclosed. This reversal thereby exposes more fuel to premature burn conditions resulting in decreased combustion efficiency and increased atmospheric emissions. This device also places the secondary combustion chamber inlet above the bottom of the primary combustion chamber. This further encourages the flow upwards through the fuel loading as occurs in updraft appliances rather than downward and aggravating the premature burn problem. In this location gaseous fuels are drawn away from rather than across or through the coals layer at the bottom. This diminished coals contact reduces flame temperature entering the secondary combustion chamber thereby reducing secondary combustion efficiency. Additionally neither device specifies means of guiding primary combustion air with minimal flow obstruction toward the secondary combustion chamber inlet.

It is these design deficiencies and more which the present invention and its embodiments seek to correct as will be apparent in the following summary of the invention.

SUMMARY OF THE INVENTION

The present invention contemplates two discreet components. They are the combustion component and the heat exchange component, the latter being adapted to capture or channel the released energy for the environmental use. The invention's primary novelty resides in the combustion component.

The combustion component herein disclosed releases virtually all of the latent energy in the solid fuel utilized in the furnace. This component is of the passive type and can be divided into three discreet and identifiable phases, specifically a fuel supply phase, a primary combustion phase and a secondary combustion phase, respectively, defined within the fuel supply zone, and, a primary combustion zone and yet a distinct secondary combustion zone.

The fuel supply zone is an enclosed volume wherein is placed the solid fuel to be consumed and below which is located the primary combustion zone which is continuously replenished with fuel from above only at the rate of consumption. The fuel may be of any type such as split cord wood, logs or artificial logs formed from any combustible material, it being more important that the fuel is physically configured as longitudinally elongated segments which may be positioned in the fuel chamber in parallel relationship with the long axes thereof.

The primary combustion zone is specially configured to receive fuel from the fuel supply zone above. A fuel orientation is thereby established such that the lowermost logs assume an inclined length with their lowest end in direct communication with the inlet of the reactor chamber located at the bottom of the primary combustion zone, said inclination providing means whereby solid fuel and coals being generated are by gravity caused to concentrate at the lower end of the primary combustion chamber and at the throat entrance. The logs are appropriately supported by structure which assures ventilation along the length of the lowermost logs.

In the primary combustion zone means are provided to admit primary air in such a manner that a jet-like stream of primary air is directed downwardly and parallel with the length of the fuel yet encountering and remaining in contact with only the bottom surfaces of the lower most fuel segments and with a trajectory specifically oriented toward the secondary combustion chamber inlet or throat. In this specific configuration, the bottom surfaces are stimulated in the presence of heat to burn. As a result of this action a combustible gaseous mixture is generated which derives ignition from the incandescent solid fuel. High temperature thereby generated and arriving at the log ends moves through the coals concentration, through the throat into the secondary combustion chamber wherein a turbulent flow pattern provides conditions for complete combustion. To assure an adequate supply of oxygen in the secondary combustion chamber, a discreet amount of secondary air is admitted to the flowing mixture at the throat and in a preheated condition.

Accordingly, it is a primary object of the invention to provide a passive, downdraft type of solid fuel burning furnace capable of efficiently extracting the latent energy from the fuel with a minimum pollutant discharge to the atmosphere.

It is the further object of the invention to provide a passive downdraft type furnace having a fuel supply chamber adapted to receive a plurality of longitudinally elongated discreet segments of solid fuel which are arranged in the chamber in parallel relationship to each other and with their long axes directed toward a constricted throat opening, said opening providing entrance to a secondary combustion chamber wherein combustion is completed. A primary air source is provided which delivers a jet-like stream of primary air in a manner which allows encounter with the bottom surfaces of the lower most solid fuel segments only and without involvement of the upper portions of the fuel, and which in the presence of heat, stimulates said bottom surfaces to decompose creating a fuel-air mixture which moves through the throat and into the secondary combustion chamber for final combustion.

It is yet another specific object of the invention to provide a furnace of the type described and including means to add preheated secondary air to the moving fuel-air mixture as it passes through the throat and enters the secondary combustion chamber.

These and other objects and advantages of the invention will become apparent in the course of the following description and explanation of the presently preferred embodiment of the invention.

BRIEF DESCRIPTION OF THE DRAWINGS

FIG. 1 is a perspective view of a furnace embodying present the invention.

FIG. 3 is a front elevational view.

FIG. 4 is a fragmentary sectional view taken along the line 4—4 of FIG. 2.

FIG. 5 is a fragmentary, sectional view taken along the line 5—5 of FIG. 2.

DETAILED DESCRIPTION OF THE INVENTION

Figure 2:
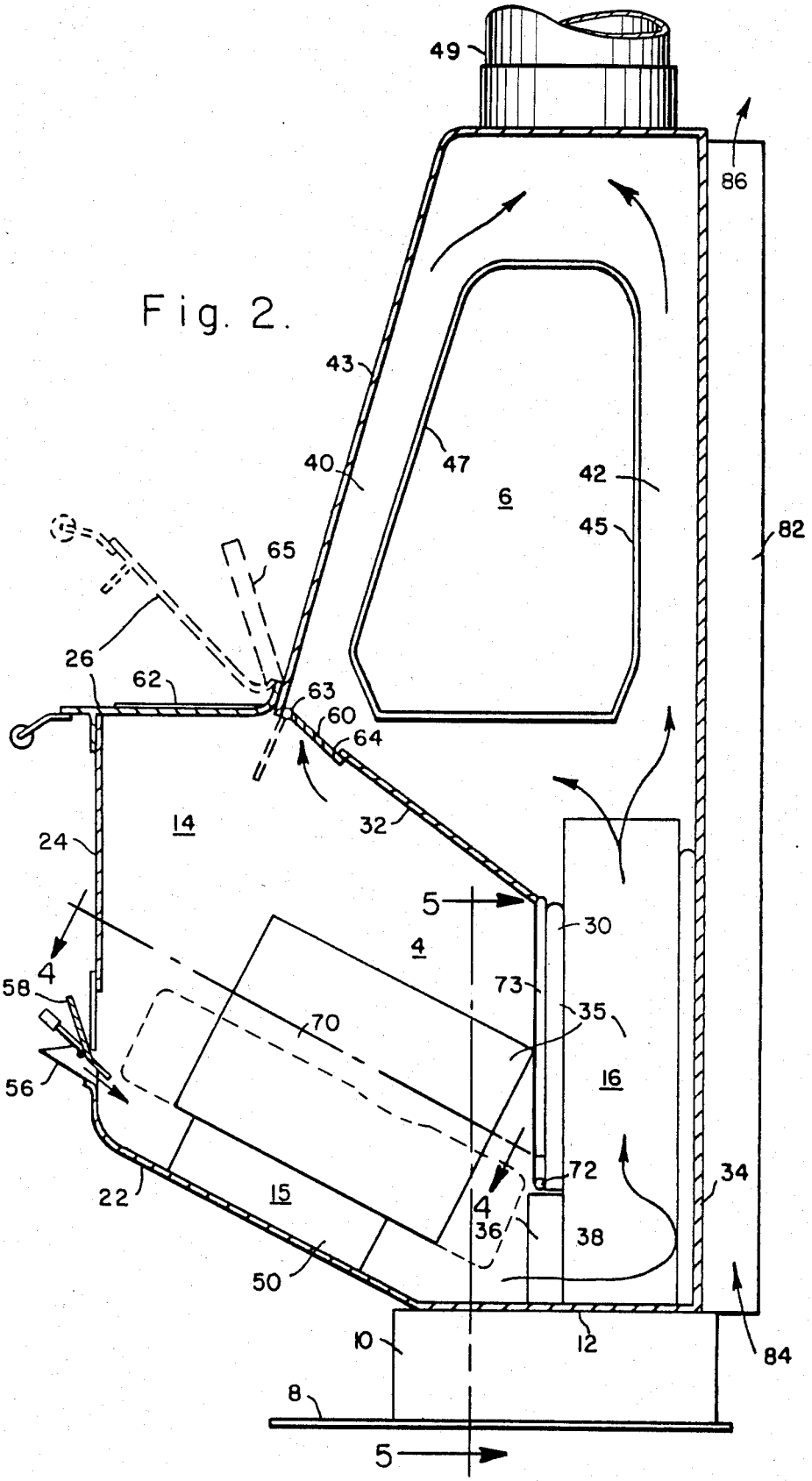
FIG. 2 is a vertical sectional view, taken from the right, of the furnace of FIG. 1.

Directing attention to the figures and particularly FIGS. 1 and 2, a furnace embodying the invention is shown. The numerals 4 and 6, respectively, generally indicate a lower combustion component and an upper heat exchange component supported by the combustion component. The entire furnace is supported from any horizontal surface by a support plate 8 and upstanding legs 10 which are securely connected to a bottom plate 12 of the combustion component 4.

The combustion component 4 comprises three functional entities. They are: an upper fuel supply 14, a primary combustion chamber and a secondary combustion chamber 16. The chambers 14 and 15 are defined by left sidewall 18, right sidewall 20, bottom plate 12, angle plate 22 and vertical plate 24. A hingeable lid 26 provides an access opening to fill the chamber 14 with fuel. Internally in the combustion component 4, the rear of chamber 14 is defined by a vertical wall 30 and thereabove by an angled plate 32 (FIG. 2). The wall 30 and angle plate 32 are connected at opposite edges thereof to the side walls 18 and 20, respectively.

The secondary combustion chamber 16 is defined by a bottom plate 12, wall 30 and rear wall plate 34, the latter being connected to side walls 18 and 20, and extending vertically the full length of the furnace. The walls 18, 20, 30 and 34 may be protectively covered by sheets of refractory material (see numeral 35) as will be understood by persons skilled in the art.

Figure 6:
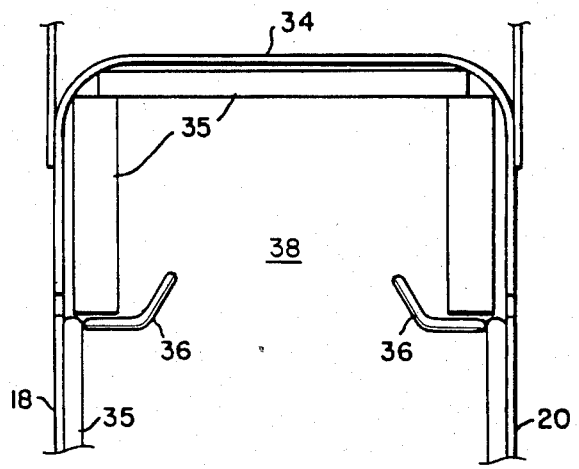
FIG. 6 is a fragmentary sectional view taken along the line 6—6 of FIG. 5.

Directing attention to FIGS. 5 and 6, it will be apparent that a lower portion of the wall 30, located adjacent to the bottom plate 12, is interrupted and provided with rearwardly bent segments 36, which define a throat or opening 38. This opening establishes communication between the primary combustion chamber 15 and the secondary combustion chamber 16 at the bottoms thereof. Segments of the surfaces in primary combustion chamber 15 and substantially all of the surfaces in the secondary combustion chamber 16, are subjected to considerable heat under the operation hereinafter described. Accordingly, it is desirable to cover these surfaces with heat resistant metal or a refractory material as stated above. The secondary combustion chamber 16 extends upwardly and flares forwardly as defined by plate 32 to communicate with front and rear channels 40 and 42 respective of the heat exchange component 6. Rear channel 42 is essentially rectangular in plan and is formed by the rear wall 34, the side walls 18 and 20, and the inner wall 45. The front channel 40 is also rectangular in cross section and is formed by front plate 43, side plates 18 and 20, and inner plate 47. The channels 40 and 42 converge at the top of the heat exchange component 6 and there communicate with flue pipe 49 which is vented to the atmosphere.

In the embodiment of the invention shown in FIG. 2, the angle plate 22, which serves as the bottom of the primary combustion chamber 15, is angled upwardly from the horizontal approximately 28 to 30 degrees. The plate 22 carries fuel supporting blocks 50 which are spaced from each other to define a channel 54 therebetween which in effect becomes the primary combustion chamber. The channel 54 is aligned with the throat or opening 38 which establishes communication between the chambers 15 and 16 and has a height which preferably is less than or equal to the height of the throat 38. The channel 54 is also aligned with an opening in the front plate 24 which carries the air regulating device 56 which is the source of primary air. Likewise, the top of the air regulating device 56 is located below the top of the supporting blocks. Thus all of the air flow between the air regulating device and the throat 38 is through the channel 54 under the fuel, thereby causing the primary air flow to be directed onto the lower most portion of the fuel. As a result as the bottom of the fuel becomes combusted, fresh portions of the fuel are gravity fed into the primary combustion chamber 15.

A pivoting closure plate 58 in the device 56 provides means for air flow adjustment. As the closure plate 58 is moved to the closed position, the primary air passing through air regulating device 56 tends to be vertically depressed in the passage 54 thereby tending to limit fuel burn to the area near the throat opening 38.

Directing attention to FIG. 2, it will be noted that the primary combustion chamber 14 is provided with an opening 60 at its upper end which is defined by angle plate 32. This opening 60 has the capability of establishing direct communication between the chamber 14 and the channel 40 of the heat exchange component 6. However, a handle 62 (FIG. 1) is privotally mounted to the furnace, as at 63, and carries, within the chamber 14, a closure plate 64 which effectively closes the opening 60 when the handle 62 is in the horizontal position shown in FIGS. 1 and 3. However, when the handle 62 is raised vertically to position 65, the opening 60 establishes communication between the channel 40 and the chamber 14.

In the preferred embodiment and in the operation of the furnace disclosed, the physical configuration of the fuel elements employed is of considerable importance. The fuel elements should generally be longitudinally elongated segments such as cylinders or cord wood logs split so that their long axes are substantially greater than their transverse dimensions. Two such elongated solid fuel elements are indicated in phantom in FIGS. 2 and 4, by the numeral 70. It is noted that they are placed within the chamber 15 by opening the lid 26 and are arranged to overlie and be supported by the fuel support blocks 50 which define the channel 54. In this posture, the fuel elements 70 have their long axes directly pointed toward the throat or opening 38 which establishes communication between the chambers 15 and 16. It will be particularly noted that the supporting blocks 50 are shorter in length than the supporting plate 22. As a result, the upper and lower ends of the fuel elements 70 are unsupported and project beyond the supporting blocks 50 where their projecting surfaces are freely subjected to circulating air.

Side walls 18 and 20 are provided with secondary air apertures 72 and 74 (FIGS. 1 and 5). The wall 30 (FIG. 7) above the throat 38 comprises refractory plate 35, metal plate 73 and sheet metal segments 75 which are attached to the plate 73. The segments 75 are bent to define air pipes 79, which are adjacent to the air apertures 72 and 74. The segments 75 are spaced to define an opening 80 and may be perforated adjacent the opening 80 to feed secondary air directly to the throat 38.

In operation, the fuel elements 70 are positioned within the chamber 14 as shown in FIGS. 2 and 4. Some light chip or paper-like material may be placed on the plate 12 immediately forwardly of the throat 38. This material then may be ignited. The handle 62 is raised to position 65 which opens the opening 60 and establishes communication between the chamber 14 and the channel 40. Initially after ignition, the furnace acts in an updraft mode and smoke and hot air rise through the chamber 14, through the opening 60 and into the channel 40 and out the flue 49. As the heat increases and the volume of smoke increases, a flow pattern through the opening 60, channel 40 and flue 49 is established which creates a draft condition within the flue 49. In effect, the draft is being primed. Primary air, of course, is entering the primary combustion chamber 15 through the device 56.

The handle 62 is then abruptly brought to its horizontal position which closes the opening 60. The primed flue 49 and the flow pattern set up therein continues to exert a negative pressure through the channels 40 and 42, thereby inducing the flow pattern to change and pass through the throat 38 up through the secondary combustion chamber 16 and to the flue 49, via channels 40 and 42. The furnace is now operating in its downdraft mode.

Figure 7:
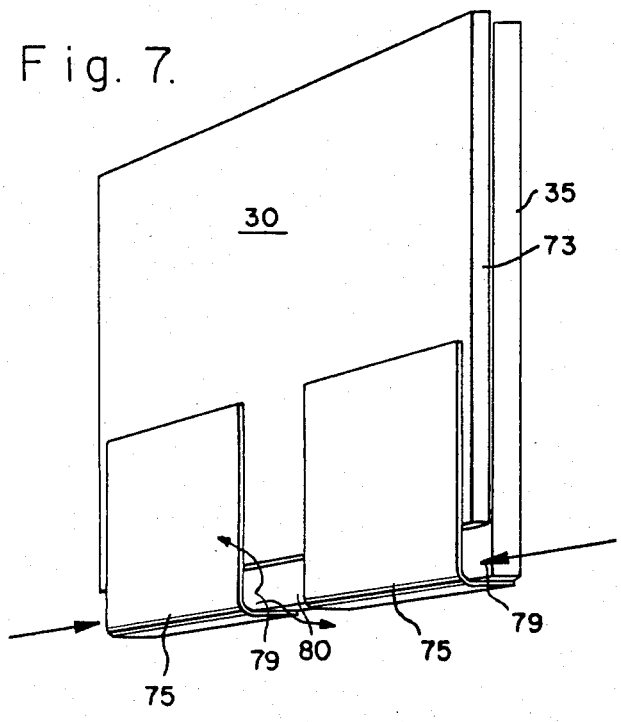
FIG. 7 is a perspective view of wall which forms a part of the stove of the present invention.

Directing attention to FIGS. 2 and 4 it will be seen that as the primary air enters at the device 56, it is guided along the channel 54 and by the longitudinal dimension of the fuel 70 to engage the lower surfaces of fuel elements as it moves in a jet-like stream. In addition, the entering primary air vortexes in the areas below the overhanging end surfaces of those elements 70. The movement of the air along these fuel element surfaces toward the opening 38 in the presence of the heat created by the burning fuel elements stimulates the fuel element surfaces to incandescence and decomposition inducing the burning thereof. A moving stream of air and combustible gases move downwardly and through the constricted throat 38. The reduced size of the throat increases the velocity of the moving fuel air mixture. At the throat 38 secondary air is provided as shown in FIGS. 5 and 7 to assure sufficient oxygen being present for complete combustion of the mixture in secondary combustion chamber 16. As the fuel-air mixture moves through the throat 38 and velocity is added, it strikes the rear wall 34 causing a vortex and turbulent flow, creating the proper intermix condition to assure complete combustion within the secondary combustion chamber 16.

The heated air and products of combustion then move upwardly in the secondary combustion chamber 16 where the flow splits, with the minor portion of the total flow entering the channel 40 and a major portion of the flow entering the channel 42 in the heat exchange component 6. As noted earlier, the channels 40 and 42 are rather narrow and rectangular in cross-section assuring intimate contact with the walls of the respective channels as the heated combustion product passes through. This provides a source of radiant and convective heat transfer directly to the environment. A plate, 82, may be affixed to the rear wall 34 of the heat exchange component 6, said plate being open-ended at the top and bottom thereof, to create an additional heat exchange channel adjacent the plate 34 whereby cold air may enter said channel at the bottom thereof and, as indicated by the arrow 84, said air being warmed by its convective contact with the plate 34 and leaving the channel at the upper end thereof as indicated by the arrow 86. At the upper ends of channels 40 and 42 the products of combustion recombine and enter the flue 49 for venting to atmosphere.

Figure 8:
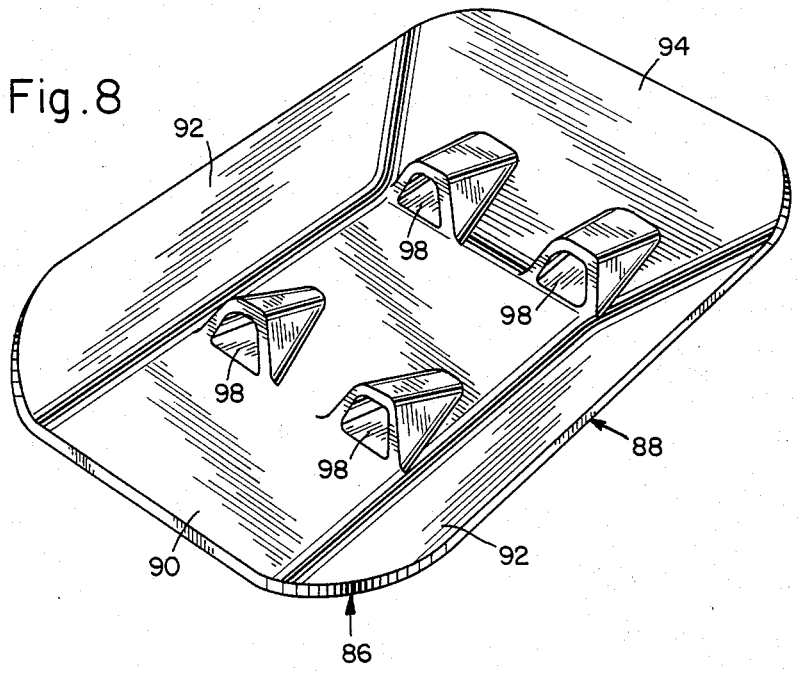
FIG. 8 is a perspective view, looking from the top, of an alternate grate assembly which is part of the stove of the present invention.
Figure 9:
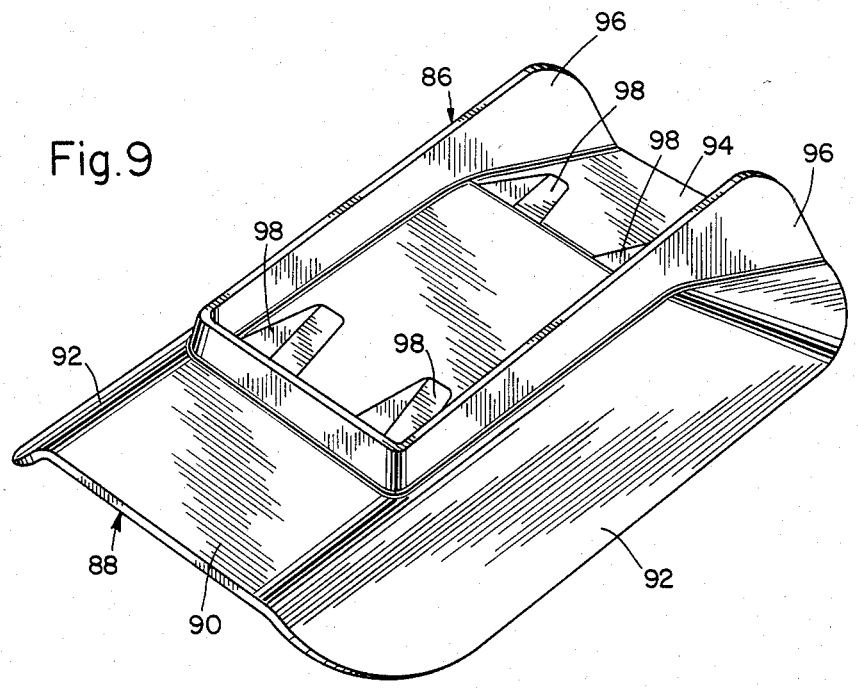
FIG. 9 is a perspective view of the grate of FIG. 8 looking from the bottom.
Figure 10:
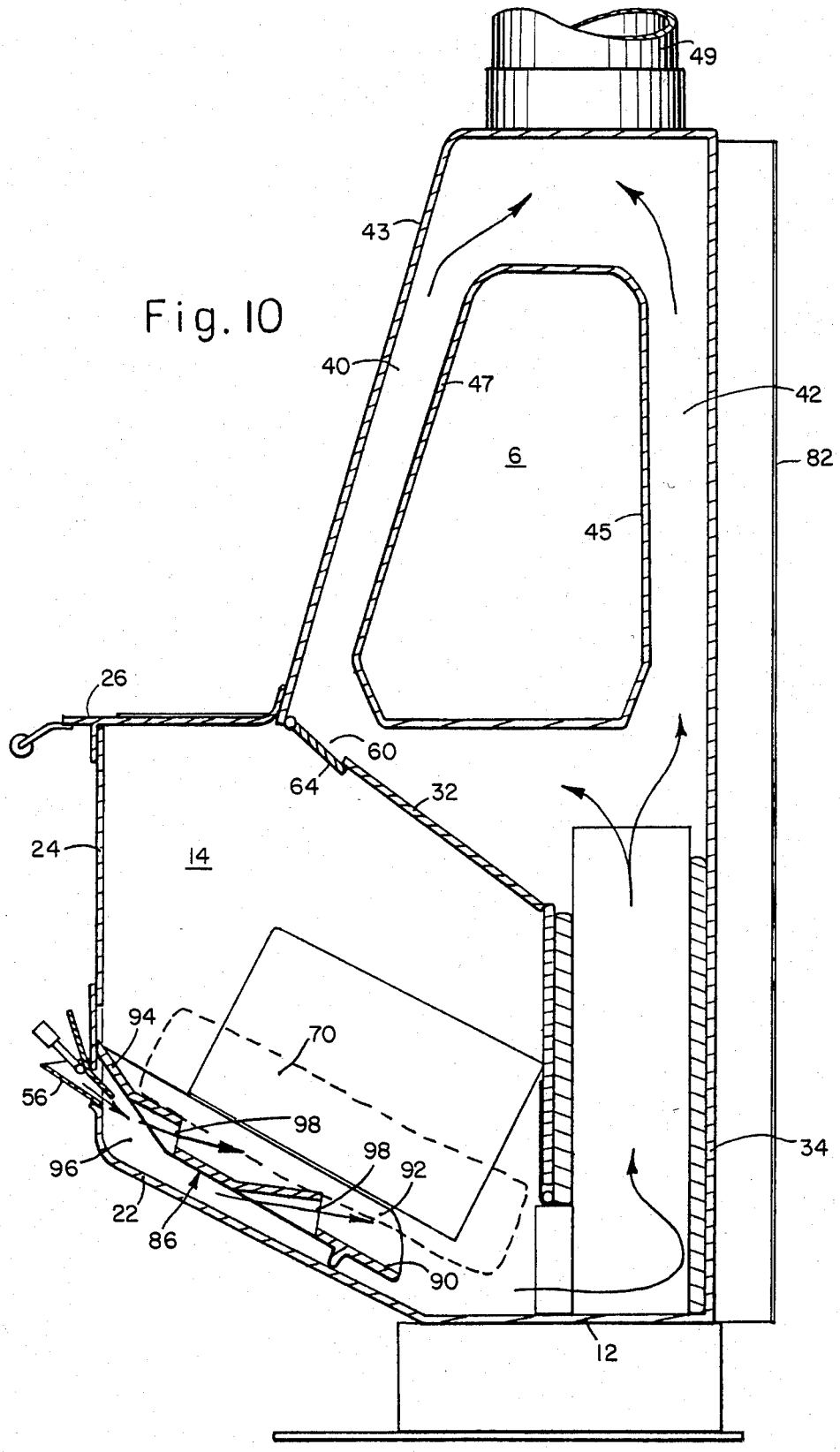
FIG. 10 is a vertical sectional view, similar to FIG. 2, showing the grate of FIG. 8 installed in the stove.

In another configuration of the stove, shown in FIGS. 8, 9 and 10, rather than fuel support blocks 50, the fuel is supported on a grate 86. The grate 86 includes a dish-shaped platform 88 having a center section 90 with paired side walls 92 and an end wall 94 which slope upwardly away from it. Unlike the support blocks 50 the platform 88 extends substantially between the side walls 18 and 20 and is nearly as long as the fuel elements 70, extending from the front plate 24 rearwardly almost to the point where the angle plate 22 intersects with the bottom plate 12.

The platform is supported above the angle plate by means of C-shaped rails 96. The open end of the rails extends up to the outer edge of the end wall 94 and the closed end extends to slightly more than half way back on the center section 90. Thus the open end of the rails abutts the front plate 24, thereby forming an enclosed cavity which is bounded by the rails 96, the platform 88 and the angle plate 22. The angle of the end wall 94 of the platform is such that it meets the front plate 24 above the air regulating device 56. As a result, all the air entering the stove through the air regulating device is directed into the cavity.

Located in the platform, above the cavity, are passageways in the form of tunnels 98 which direct the air entering the cavity through the grate and onto the lower surface of the fuel elements 70. Thus the velocity and direction of the primary combustion air can be controlled in a predetermined manner to give the desired burning characteristics and it can be directed along the lower surfaces of the fuel elements 70 so that as combustion occurs the fuel is constantly being replenished by the gravity feeding of the fuel elements down the inclined surface of the grate. As a result the fuel constantly will be replenished from above and does not have to be mechanically readjusted.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A downdraft solid fuel-burning furnace comprising:

(a) a shell;

(b) a primary combustion chamber defined in said shell;

(c) means for supporting fuel in said primary combustion chamber, with at least a portion of the bottom surface of said fuel being exposed for combustion;

(d) a primary air inlet located in said primary combustion chamber;

(e) a secondary combustion chamber defined in said shell and separated from said primary combustion chamber;

(f) a throat fluidly connecting said primary combustion chamber to said secondary combustion chamber;

(g) an exhaust flue exiting from said secondary combustion chamber; and (h) channel means for receiving and directing air flowing between said air inlet and said throat along only said bottom surface of said fuel.

2. The furnace of claim 1 wherein said channel means is defined by said means for supporting fuel and the fuel supported thereon.

3. The furnace of claim 2 wherein said means for supporting said fuel orient said fuel at an angle from the horizontal with the lowermost portion of said fuel being located proximate said throat.

4. The furnace of claim 3 wherein said channel means is arranged to direct said air flow primarily toward said lowermost portion of said fuel.

5. The furnace of claim 4 wherein said means for supporting said fuel comprises log support means for carrying logs with the longitudinal axes thereof generally parallel to each other.

6. The furnace of claim 5 wherein said log support means comprises at least two horizontally separated elongate support blocks.

7. The furnace of claim 5 wherein said shell includes a lower surface which defines the bottom of said primary combustion chamber and said log support means includes a grate comprising:

(a) platform means, having a width which is substantially equal to the width of said primary combustion chamber, for supporting logs thereon;

(b) rails supporting said platform a spaced distance above said lower surface;

(c) said rails, lower surface and platform together defining an enclosed cavity which captures all of the air which enters said primary combustion chamber through said primary air inlet; and (d) passageway means defined in said platform above said cavity for directing the air entering said cavity over the logs supported on said platform.

8. The furnace of claim 7 wherein said passageway means comprises tunnels which extend upwardly from said platform.

9. A down draft solid fuel-burning furnace comprising:

(a) a shell;

(b) a primary combustion chamber defined in said shell;

(c) said primary combustion chamber having a bottom surface which slopes downwardly, thereby forming an upper end and a lower end;

(d) a primary air inlet located in said primary combustion chamber proximate the upper end of said bottom surface;

(e) a secondary combustion chamber defined in said shell and separated from said primary combustion chamber;

(f) a throat fluidly connecting said primary combustion chamber to said secondary combustion chamber, said throat being located proximate the lower end of said bottom surfaces; and (g) an exhaust flue exiting from said secondary combustion chamber.

10. The furnace of claim 9 including means for supporting fuel a predetermined distance above said bottom surface of said combustion chamber.

11. The furnace of claim 10 wherein said predetermined distance is not substantially greater than the vertical extent of said throat.

12. The furnace of claim 11 wherein the distance from the bottom surface of said combustion chamber to the upper margin of said primary inlet is not substantially greater than said predetermined distance.

13. The furnace of claim 12 including closure plate means associated with said primary inlet for selectively reducing the distance from the bottom surface of said combustion chamber to the upper margin of said primary inlet.

14. The furnace of claim 12 wherein said means for supporting fuel comprises log support means for carrying logs with the longitudinal axes thereof generally parallel to each other.

15. The furnace of claim 13 wherein said log support means comprises at least two horizontally separated elongate support blocks.

16. The furnace of claim 13 wherein said log support means includes a grate comprising:

(a) platform means, having a width which is substantially equal to the width of said primary combustion chamber, for supporting logs thereon;

(b) rails supporting said platform a spaced distance above said bottom surface of said combustion chamber;

(c) said rails, lower surface and bottom surface of said combustion chamber defining an enclosed cavity which captures all of the air which enters said primary combustion chamber through said primary air inlet; and (d) passageway means defined in said platform above said cavity for directing the air entering said cavity over the log supported on said platform.

* * * * *